US009567049B2

(12) United States Patent
Ulgen

(10) Patent No.: US 9,567,049 B2
(45) Date of Patent: Feb. 14, 2017

(54) SELF-ADJUSTABLE PITCH PROPELLER

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 466 days.

(21) Appl. No.: 14/254,452

(22) Filed: Apr. 16, 2014

(65) Prior Publication Data

US 2015/0086370 A1 Mar. 26, 2015

Related U.S. Application Data

(63) Continuation-in-part of application No. 14/033,064, filed on Sep. 20, 2013.

(30) Foreign Application Priority Data

Oct. 3, 2013 (TR) ..... 2013/11584

(51) Int. Cl.
*B63H 3/00* (2006.01)
*B63H 3/04* (2006.01)

(52) U.S. Cl.
CPC ..... *B63H 3/04* (2013.01); *B63H 3/008* (2013.01)

(58) Field of Classification Search
CPC ..... F04D 29/36; F04D 29/362; B63H 3/00; B63H 3/02; B63H 3/12; B63H 3/04; B63H 3/008
See application file for complete search history.

(56) References Cited

U.S. PATENT DOCUMENTS

| | | | | |
|---|---|---|---|---|
| 3,295,610 | A * | 1/1967 | Frias | B63H 3/008 416/137 |
| 3,497,306 | A * | 2/1970 | Phillips | B63H 3/008 416/136 |
| 3,676,016 | A * | 7/1972 | Feroy | B63H 3/082 416/157 R |
| 4,538,962 | A * | 9/1985 | McCain | B63H 23/34 416/146 R |
| 4,810,166 | A | 3/1989 | Sawizky et al. | |
| 2011/0189018 | A1 | 8/2011 | Thyberg | |
| 2011/0200433 | A1 | 8/2011 | Forsstrom | |

* cited by examiner

*Primary Examiner* — Craig Kim
*Assistant Examiner* — Danielle M Christensen
(74) *Attorney, Agent, or Firm* — Vidas, Arrett & Steinkraus, P.A.

(57) ABSTRACT

A self-adjustable pitch marine vessel propeller attached to a shaft is driven by an engine of a marine vessel, and includes a substantially cylindrical hollow hub and a plurality of blades extending radially outwardly from the hub and being capable of rotating around an axis being in a radial direction relative to the hub. The propeller comprises an actuator movable linearly along the axis of the hub and at least one motion transmission means communicating with the actuator and each blade for converting the linear motion of the actuator into the rotational motion of each blade in a radial direction relative to the axis of the hub and a resilient member communicating with the actuator.

12 Claims, 9 Drawing Sheets

SELF-ADJUSTABLE PITCH PROPELLER

CROSS-REFERENCE TO RELATED APPLICATIONS

This Continuation in Part patent application, claims priority to U.S. patent application Ser. No. 14/033,064, filed on Sep. 20, 2013.

STATEMENT REGARDING FEDERALLY SPONSORED RESEARCH

Not applicable.

BACKGROUND OF THE INVENTION

The present invention relates to a self-adjustable pitch propeller for marine vessels.

A propeller is designed by taking many parameters into account in order to provide the optimum thrust to the marine vessel provided therewith. For example, design parameters such as dimensions of the marine vessel body, load of the marine vessel, engine power, density of the water the marine vessel cruises on are important inputs for determining the diameter and pitch of the propeller to be produced. Once a propeller designed with the blades thereof being static relative to the hub thereof has been produced, the propeller may become heavy in torque against the cruise conditions if the pitch thereof is large and it requires more power from the engine. However, if the pitch is low, i.e. if it is 'light', it cannot deliver enough engine power as thrust. In either case, performance of the propeller falls. Such a propeller designed with the blades thereof being static relative to its hub (not adjustable pitch) is known as the 'fixed pitch propeller'.

Modification attempts against the lightness of the propeller do not work and a new propeller needs to be used. In the case where the propeller is heavy as term, the diameter can be downsized, however this brings along a number of problems (e.g. mass balancing problem of the propeller can take place due to the centrifugal force exerted, it cannot be possible for each blade to uniformly face water). Nevertheless such modification does not mean obtaining a propeller providing high performance in changing cruise condition, because when the conditions of the marine vessel changes, when the load thereof increases for instance, the performance of fixed pitch propeller falls again. For this reason, variable pitch type propellers have been proposed. Use of variable pitch propellers against variable conditions such as marine vessel speed and load improves the performance (and therefore reduces fuel consumption). On the other hand, blades of the variable pitch propellers are rotated by a certain amount relative to the blade hub so as to provide the optimum pitch by being controlled according to each changing condition. This often requires using a complex and costly control/drive mechanism.

Typically, the pitch of a propeller is calculated according to shaft torque at which the motor that the propeller attached to is in its maximum speed (rpm). However, it is known that there is a considerable torque (and so power) difference between the shaft and propeller when the motor is run at moderate and lower speeds for maintaining fuel consumption lesser. At moderate and lower motor speeds, propellers produce less torque and therefore propellers should have a higher pitch to be economic in terms of fuel consumption and to increase cruise speed at such motor speeds. There seems to be no affordable and straightforward solution for self-adjusting the pitch of a propeller according to the motor speed.

Therefore, a propeller providing optimum thrust to a marine vessel according to the changed cruise conditions such as load and speed by adjusting the pitch in a simple and inexpensive way is needed.

BRIEF SUMMARY OF THE INVENTION

An object of the present invention is to provide a propeller providing optimum thrust to a marine vessel according to cruise conditions.

Another object of the present invention is to provide a propeller having the pitch thereof being self-adjusted in a simple and relatively inexpensive way.

In accordance with the above objects, the present invention relates to a self-adjustable pitch marine vessel propeller attached to a shaft driven by an engine of a marine vessel, comprising a substantially cylindrical hollow hub and a plurality of blades extending radially outwardly from the hub and being capable of rotating around an axis being in a radial direction relative to the hub. The propeller according to the present invention comprises an actuator movable linearly along the axis of the hub; at least one motion transmission means communicating with the actuator and each blade for converting the linear motion of the actuator into the rotational motion of each blade in a radial direction relative to the axis of the hub; and a resilient member communicating with the actuator.

According to an embodiment of the present invention, at least a portion of the actuator can linearly move inside a cavity formed in the axial direction in the hub. The external geometrical form of the actuator is compatible with the geometrical form of the cavity formed inside the hub and cross section of said form preferably comprises a cornered geometry such as a pentagon, square, etc.

According to an embodiment of the present invention, the self-adjustable pitch propeller comprises a structure being adaptable to the already existing propeller shafts. This is achieved by means of a sleeve longitudinally placed on the propeller shaft. The actuator is placed on the sleeve so as to perform linear motion thereon.

According to an embodiment of the present invention, the linear motion of the actuator along the axis of the hub is provided by means of a threaded shaft communicating with the actuator.

According to an embodiment of the present invention, the resilient member is a mechanical spring and it is particularly a spiral spring.

BRIEF DESCRIPTION OF THE SEVERAL VIEWS OF THE DRAWINGS

Embodiments of the present invention and advantages thereof with the additional components should be considered together with the figures explained below in order to be fully understood.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
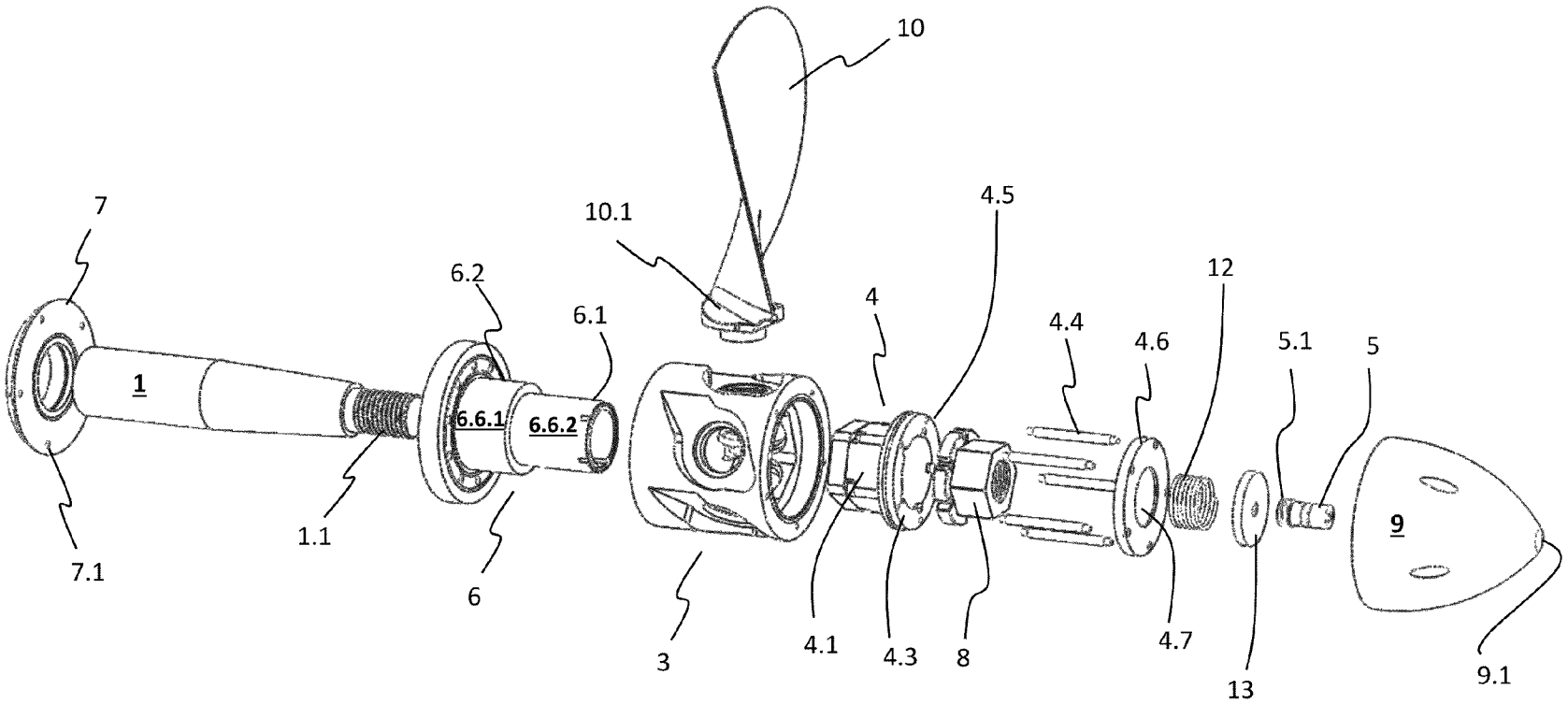
FIG. 1 is an exploded perspective view of the self-adjustable pitch propeller according to the present invention.

As shown in FIG. 1, the self-adjustable pitch propeller (2) according to the present invention is axially attached on a propeller shaft (1). The propeller shaft (1) is driven by an engine (not shown in the figures) of a marine vessel connected thereto. Threads (1.1) are formed along a certain length on an end portion of the propeller shaft (1) and the propeller (2) is fixed to the shaft (1) after being fitted thereon by tightening of a nut (8) being placed on the threads (1.1) of the propeller shaft (1).

The propeller (2) comprises a cylindrical hub (3) and a plurality of blades (10) extending radially outwardly from the hub (3). The hub (3) comprises a front end (3.4) and a rear end (3.5) and an open cavity (3.1) formed along the axis thereof. The cross section of the hub cavity (3.1) preferably comprises a cornered geometry such as a pentagon, hexagon, square etc. along almost the entire axis thereof. The cross sectional geometry on an end (3.5) portion of the hub cavity (3.1) is partially circular and a cross sectional narrowing takes place when being advanced from the circular cross section to the cross section with cornered geometry. The cross sectional narrowing defines an abutting surface (3.7) for the actuator (4) to be described later.

The hub (3) comprises a plurality of blade connection openings (3.3) formed circularly along the hub thickness in the radial direction. Blade seating surfaces (3.2) are formed around each of the blade connection openings (3.3). Said blade seating surfaces (3.2) start from the external surface of the hub (3) and partially extend radially inwardly.

An actuator (4) moving linearly in the direction of the axis of the hub (3) is placed partially into the hub cavity (3.1). The actuator (4) has a longitudinal form and comprises longitudinal actuator advancing surfaces (4.1) entering into the hub cavity (3.1). The cross sectional geometry of the actuator advancing surfaces (4.1) are compatible with the cross sectional geometry of the hub cavity (3.1). Namely, the cross sectional geometry of the actuator advancing surfaces (4.1) also comprises preferably a cornered geometry such as a pentagon, hexagon, square etc. In this situation, the actuator advancing surfaces (4.1) cooperates with the hub interior cavity surfaces (3.6). However, in terms of dimensions, the cross section of the actuator advancing surfaces (4.1) are made slightly smaller than the cross section of the hub cavity (3.1) such that the linear advancing of the actuator (4) inside the hub (3) can be possible.

The inner portion of the actuator (4) comprises a cavity having a circular cross section along the axis thereof. The inner surface (4.8) of the actuator (4) is dimensioned so as to sit on the propeller shaft (1) and to linearly move thereon.

Actuator slots (4.2) arranged circularly in the radial direction and formed so as to have the same number with the blades are disposed on the advancing surfaces (4.1) of the actuator. Motion transmission pins (10.3) to be described later are fitted in the slots (4.2). The actuator comprises an actuator flange (4.3) protruding radially outwardly on the other end thereof, i.e. where no slots (4.2) are formed. The actuator flange (4.3) is placed inside the circular cross section of the hub cavity (3.1) and preferably abuts to the abutting surface (3.7) at a maximum advancing position of the actuator (4).

The actuator (4) further comprises rods (4.4) extending from the actuator flange (4.3) towards the other end thereof and an actuator disc (4.6) connected to said rods (4.4). Rod connection slots (4.5) are formed on the actuator flange (4.3) as well as the actuator disc (4.6) for the connection of the rods (4.4). The rods (4.4) are provided with circular form, wherein a cavity is disposed in the middle portion thereof such that the propeller connection nut (8) is placed into said cavity.

A seating surface (4.7) having an annular shape is formed at a remote surface of the actuator disc (4.6). A spring (12), being preferably a spiral spring, is abutted from one of its end to the seating surface (4.7). From the opposite end the spring (12) is abutted to a support plate (13), thus the support plate (13) is arranged apart from the actuator disc (4.6). The spring (12) can have any proper rigidity according to cruising conditions, properties of the marine vehicle to which the propeller is to be attached and so forth.

On the reverse side of the support plate (13) a shaft (5) is fixed at the center thereof. The fixation of the shaft (5) is provided by a bolt (14) running into the shaft (5), which is introduced from the side where the spring is arranged. Threads (5.1) are axially formed along a certain distance at the end of the shaft (5) close to the support plate (13). A wrench groove (5.2) extending axially inwardly from the opposite end (i.e. not threaded end) of the shaft (5) is formed. The wrench groove (5.2) can be provided with a form so as to be rotated with for example an Allen wrench.

Figure 2:
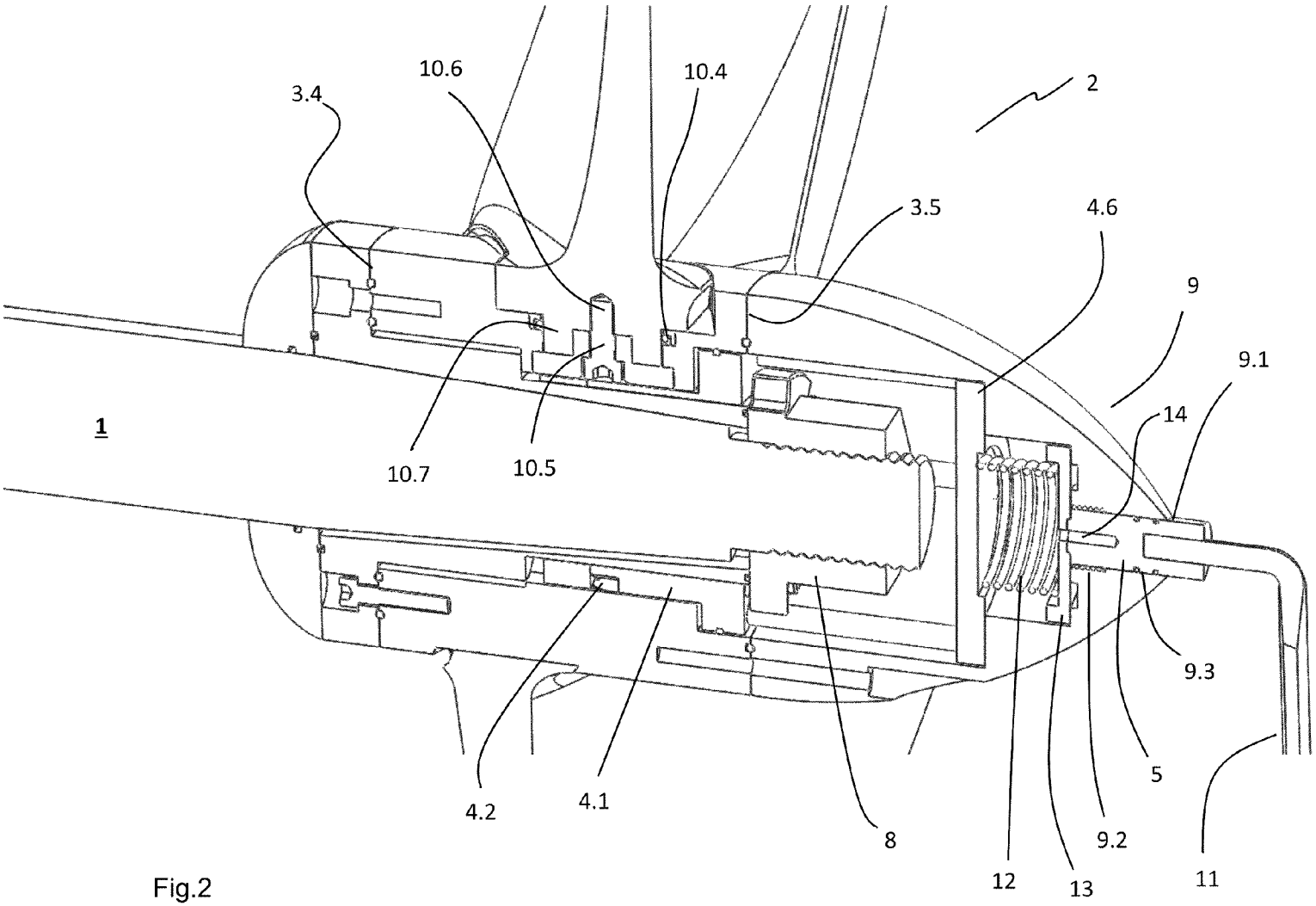
FIG. 2 is an assembled cross sectional perspective view of the self-adjustable pitch propeller according to the present invention with the wrench being placed.
Figure 3:
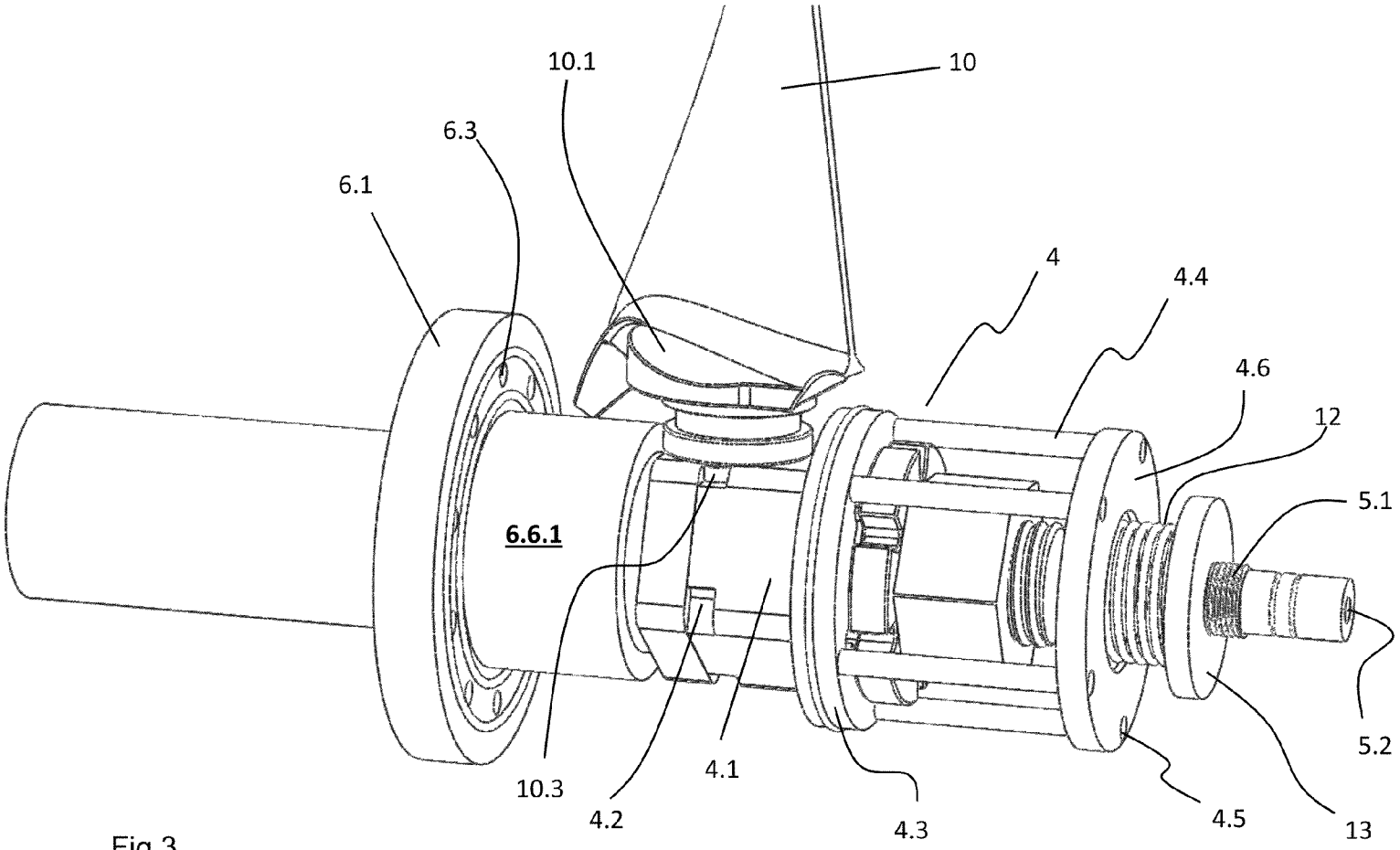
FIG. 3 is an assembled perspective view of the self-adjustable pitch propeller according to the present invention without the hub.
Figure 4:
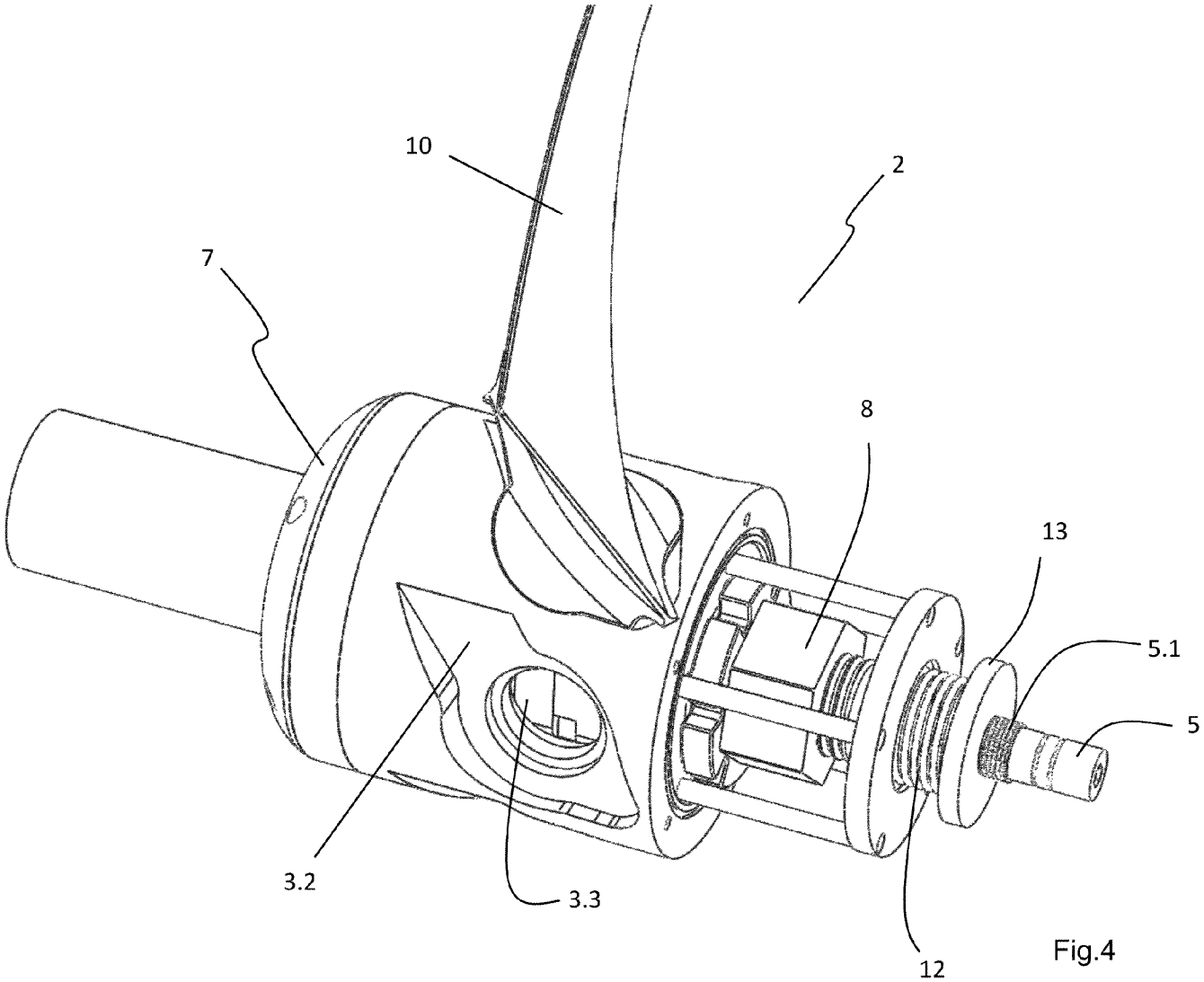
FIG. 4 is an assembled perspective view of the self-adjustable pitch propeller according to the present invention without the conical piece.

A conical piece (9) having a gradually tapering form for proper flow of the water leaving the propeller (2) is fixed on the rear end (3.5) portion of the hub. As shown in FIG. 2, the inner portion of the conical piece (9) comprises a cavity so as to receive the spring (12), support plate (13), the actuator disc (4.6), rods (4.4), propeller connection nut (8) and respective portion of the propeller shaft (1). The conical piece (9) also comprises a circular shaft cavity (9.3) extending axially starting from the pointed end portion thereof. Screw threads (9.2) are formed along a certain length on the shaft cavity (9.3). The screw threads (9.2) of the conical piece are compatible with the shaft threads (5.1) so as to work together. A wrench hole (9.1) is formed on the tapered end portion of the conical piece (9). In cases where conical piece (9) is not desired to be used, it should be appreciated that the hub (3) can be extended to the rear and the screw threads (9.2) of the conical piece in said case can be configured on the inner portion of the extended hub.

As shown in FIG. 2, when a wrench (11) such as an Allen wrench is rotated by being placed into the wrench groove of the shaft, the shaft threads (5.1) advance the shaft (5) by moving on the conical piece threads (9.2). In use, the shaft (5) pushes the support plate (13) and moves the same, which starts compressing of the spring (12). Depending on the rigidity of the spring (12), it is compressed up to a certain point and then the spring pushes the actuator disc (4.6) providing an axial displacement of the actuator (4).

Each blade (10) comprises a blade-hub connection end (10.1) connected to the hub (3). The lower surfaces of the blade-hub connection ends (10.1) seat on the blade seating surfaces (3.2) formed on the hub (3). However, this is not a form-fitting seating, i.e. it is a loose seating, because, as will be described later, the blades (10) should be seated with a clearance so as to be rotated in their radial direction relative to the hub axis.

Figure 5:
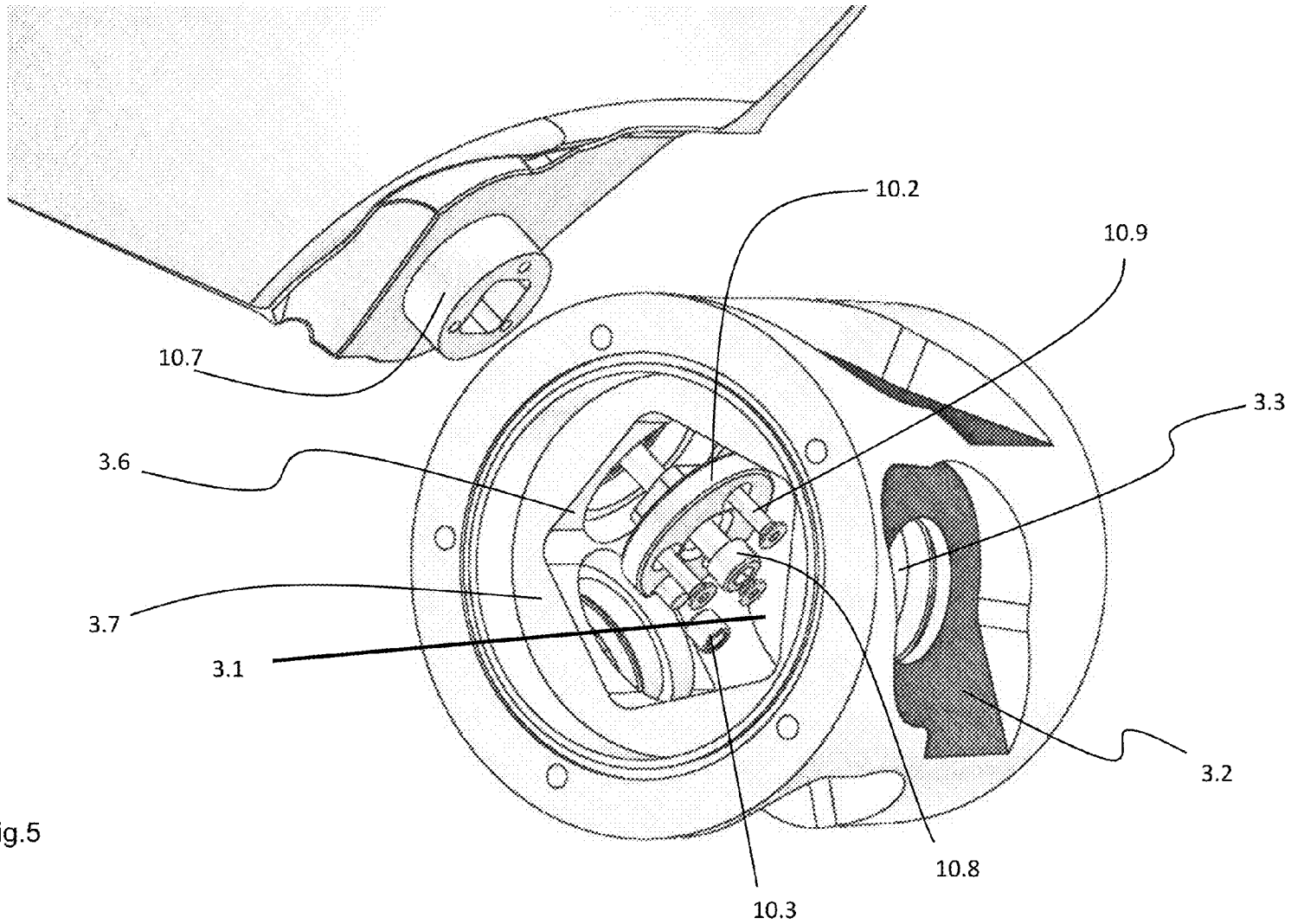
FIG. 5 is a detailed perspective view of the hub blade connection.
Figure 6A:
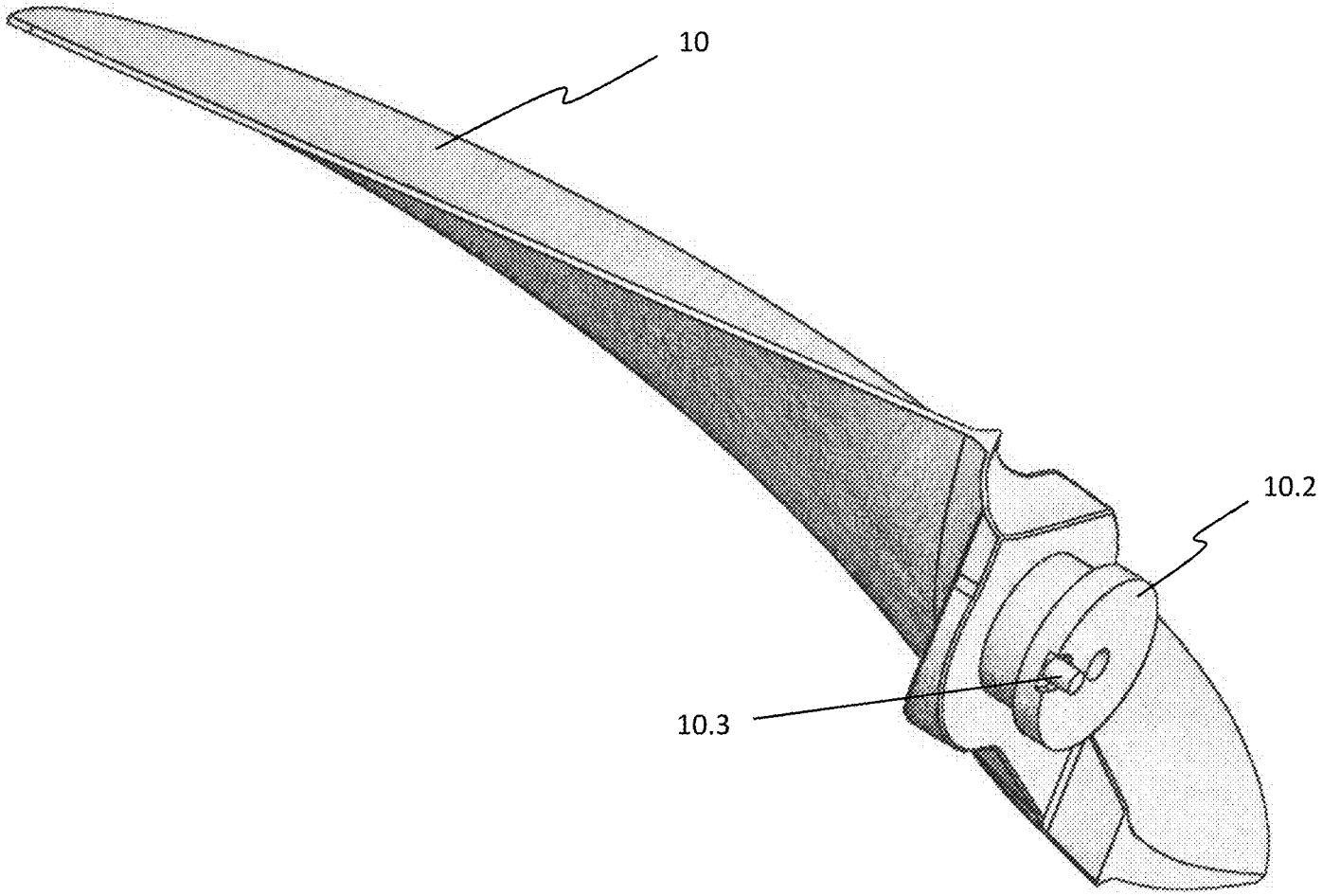
FIG. 6A is a perspective view of the blade and motion transmission element connected thereto.
Figure 6B:
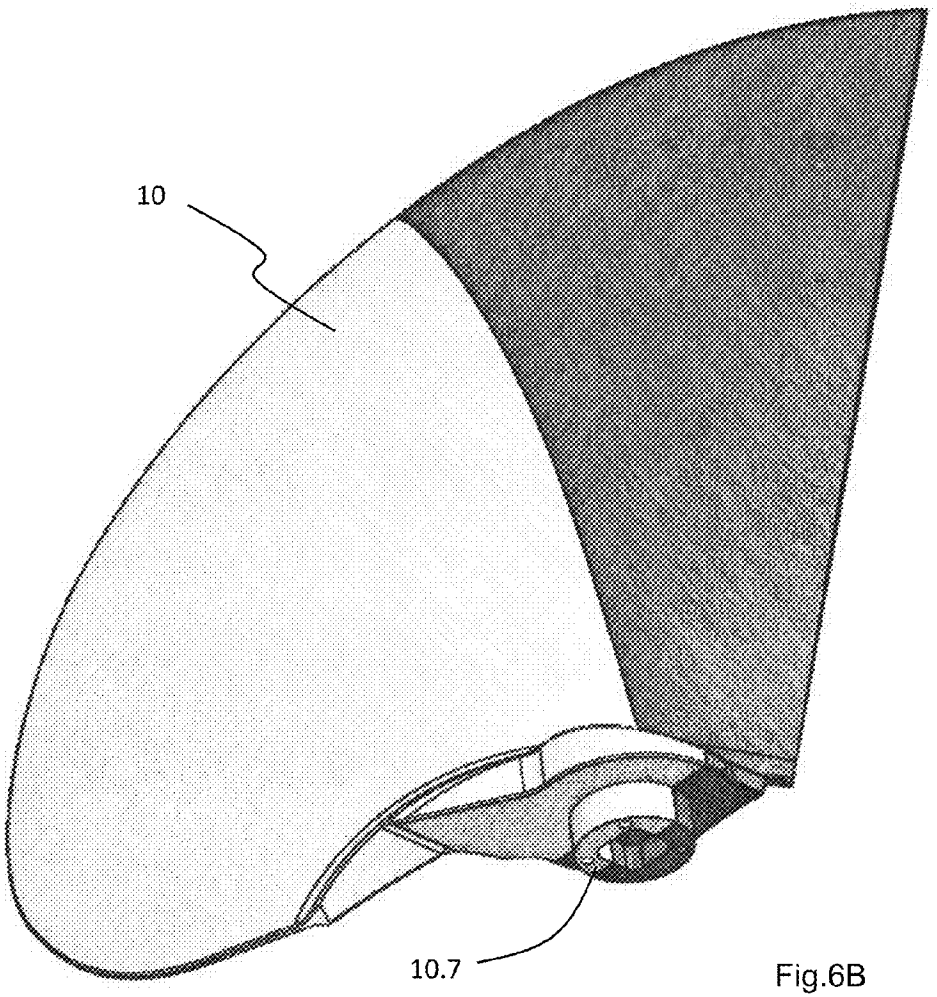
FIG. 6B is a perspective view of a blade of the invention.
Figure 7:
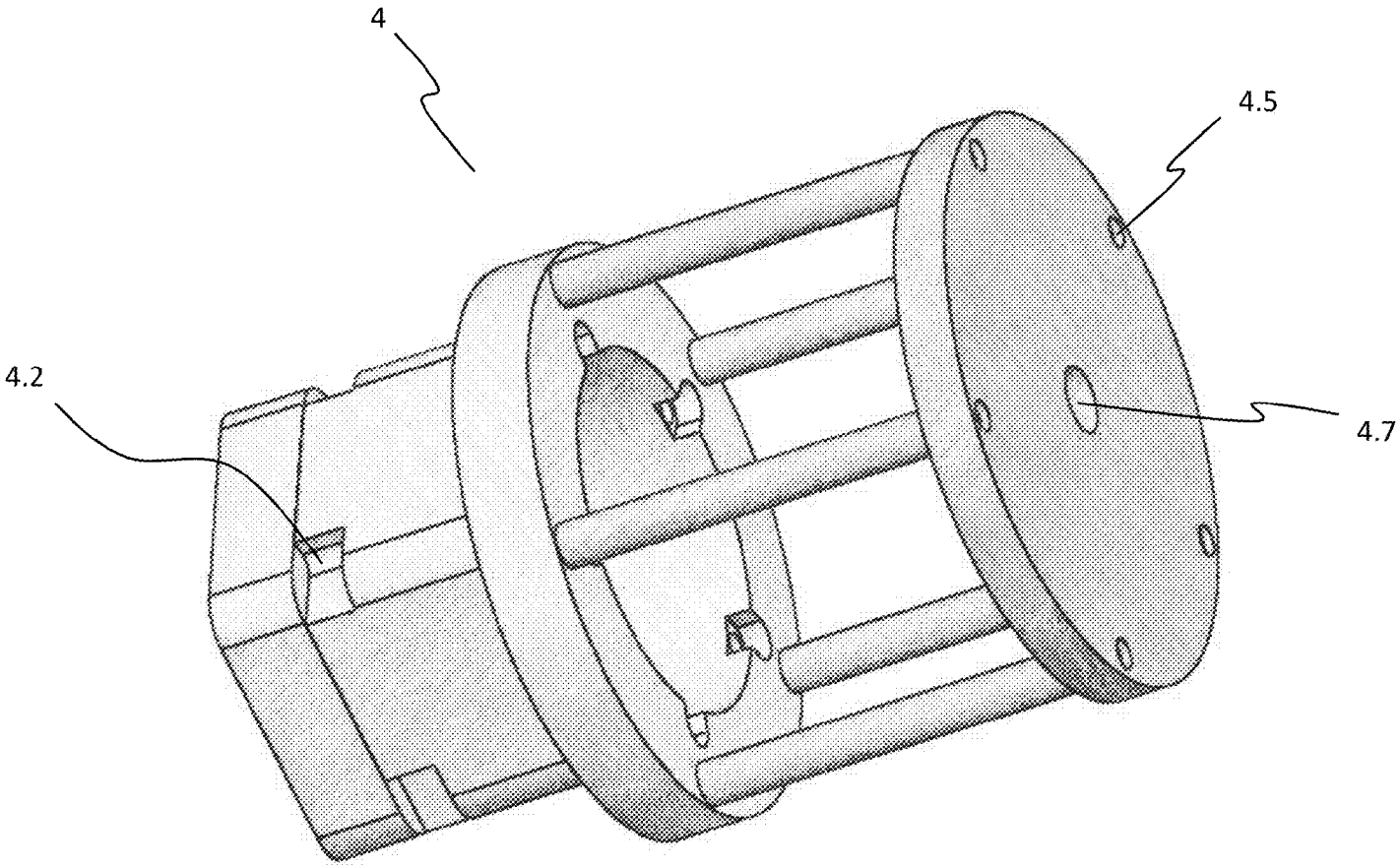
FIG. 7 is a perspective view of the actuator.
Figure 9:
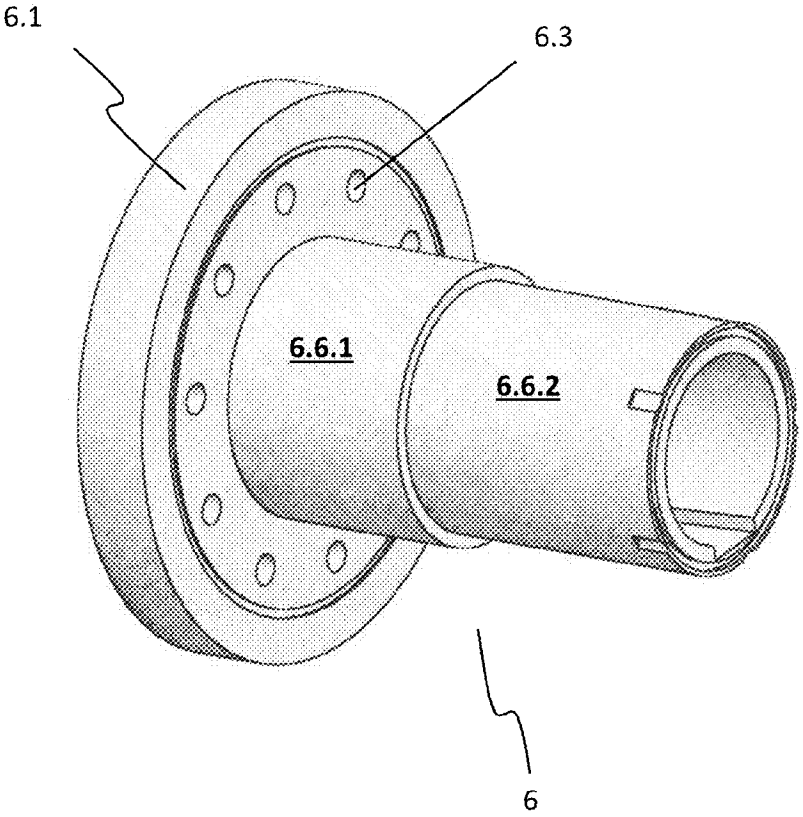
FIG. 9 is a perspective view of the shaft sleeve.
Figure 8:
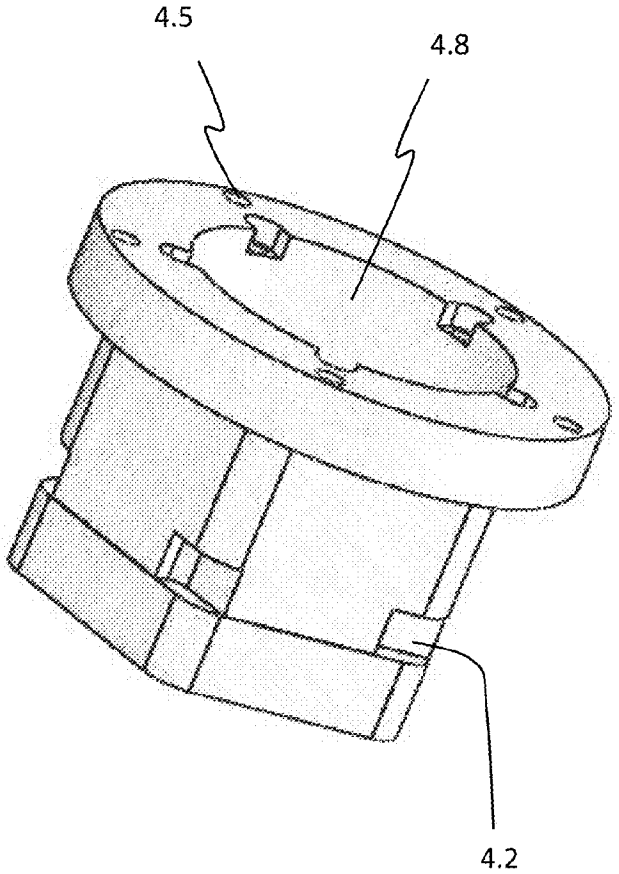
FIG. 8 is a perspective view of the portion of the actuator remaining inside the hub.

A motion transmission means (10.2) is provided in the lower portion of each blade-hub connection end (10.1) so as to be disposed on the blade connection opening (3.3). The motion transmission means (10.2) have preferably a disc-like form and there is provided a bolt slot (10.5) at the center thereof. There is also provided a bolt slot (10.6) in the lower portion of each blade (10). When the motion transmission means (10.2) is placed in the lower portion of the respective blade (10), the bolt slot (10.5) of the motion transmission means is aligned with the bolt slot (10.6) of the blade and then the motion transmission means (10.2) is fixed to the respective blade (10) by means of making a bolt connection. The bolt (10.8) is preferably an Allen type of bolt and after the bolt slots (10.5, 10.6) are aligned, the Allen bolt (10.8) is inserted into the hub (3) and then tightened by means of an Allen wrench. The blade and hub connection can be additionally strengthened by using additional bolts (10.9) as shown in FIG. 5.

Each of the motion transmission means (10.2) in the form of a disc comprises a motion transmission pin (10.3) disposed at a certain distance from the center thereof and extending in the axial direction therefrom. Each of the motion transmission pin (10.3) is shaped so as to be received by the respective slot (4.2) formed on the advancing surfaces (4.1) of the actuator.

As mentioned above, when the shaft (5) is rotated, thus, the actuator (4) is advanced, each motion transmission pin (10.3) disposed in the actuator slot (4.2) is pushed to rotate a certain amount about the axis of the motion transmission means (10.2). Thus, the disc shaped motion transmission means (10.2) also rotates a certain amount about the axis thereof; because, the motion transmission means (10.2) is not rigidly connected to the hub (3), i.e. the motion transmission means (10.2) is movable relative to the hub (3). The motion transmission means (10.2) is rotatably disposed inside a cavity formed inside the hub (3) (blade connection opening).

Since each motion transmission means (10.2) is rigidly connected to the respective blade, when the motion transmission means (10.2) rotates, the blade (10) connected thereto also rotates about an axis radial to the axis of the hub (3). Thus, the pitch of the blades (10) can be manually adjusted as desired by means of a wrench (11).

According to a preferred embodiment of the invention, blades are initially set to have relatively high pitch. Thus, area of blade surfaces counteracting water is increased, which is needed when relatively higher thrust is required. In cases where the marine vehicle navigates in normal cruising mode, which requires relatively less thrust, the pitch of the blades is adjusted by itself. As the water force exerted on the blades increases the actuator (4) is forced to move towards the tapering end of the conical piece, the water force is balanced by the reaction force of the spring (12) up to a certain threshold value and once the threshold reaction force is exceeded, the actuator (4) is moved to a point where the water force is balanced with the reaction force of the spring. Thus, the pitch is adjusted by itself.

Any resilient member in place of the spring can be used between the actuator (4) and the shaft (5). The resilient member can be a rubber or a compressible fluid and so forth. In case a compressible fluid is used, this fluid is retained in a closed container.

As shown in FIG. 5, a cylindrical projection (10.7) extending downward from the hub connection end (10.1) of each blade is provided. A protrusion extending upward from the motion transmission means (10.2) fits inside the cavity of said projection (10.7). An O-ring (10.4) is disposed around the blade connection end projection (10.7). Thus, in the case the components (shaft threads, conical piece threads, motion transmission means, etc.) adjusting the pitch of the blades (10) are lubricated, the ingression of sea water into these components is prevented.

According to an embodiment of the present invention, the self-adjustable pitch propeller can be designed so as to be adapted to the already existing propeller shafts. To achieve this, a shaft sleeve (6) is coaxially fitted on the propeller shaft (1). The shaft sleeve (6) comprises a flange (6.2) at one of its end and a staged cylinder (6.1) extending axially therefrom. The diameter of the first stage (6.6.1) of the shaft sleeve cylinder is greater than the diameter of the second stage (6.6.2) thereof. The outer diameter of the second stage (6.6.2) of the cylinder is slightly smaller than the diameter of the circular inner surface (4.8) of the actuator (4), thus, when the actuator (4) is seated on the second cylinder stage (6.6.2), it can move linearly thereon.

The outer diameter of the shaft sleeve flange (6.2) is substantially same as the outer diameter size of the hub (3). A static balance disc (7) is mounted on the propeller shaft (1) so as to correspond to the other end of the shaft sleeve flange (6.2). The static balance disc comprises disc connection holes (7.1) formed axially along the thickness thereof. In the case of mounting, the front end (3.4) of the hub abuts the shaft sleeve flange (6.2) and the circular connection holes (6.3) formed axially along the thickness of said flange (6.2) are aligned with the disc connection holes (7.1) as well as the connection holes formed circularly on the front end of the corresponding hub; then, these components (static balance disc, shaft sleeve and hub) are fixed by means of connection elements such as bolts.

The static balance disc (7) can be used to eliminate any possible mass imbalances of the propeller hub (3) or blades (10), which may occur due to manufacturing defects. In this case, the unbalanced mass is balanced by a mass (counter weight) against the static balance disc (7).

This completes the description of the preferred and alternate embodiments of the invention. Those skilled in the art may recognize other equivalents to the specific embodiment described herein which equivalents are intended to be encompassed by the claims attached hereto.

What is claimed is:

1. A self-adjustable pitch marine vessel propeller (2) attached to a shaft (1) driven by an engine of a marine vessel, comprising a substantially cylindrical hollow hub (3) and a plurality of blades (10) each extending radially outwardly from said hub (3) and being capable of partially rotating around an axis being radial to the hub (3), characterized in that the propeller comprises an actuator (4) linearly movable along the hub (3) axis; at least one motion transmission member (10.2) communicating with the actuator (4) and each blade (10) for converting the linear motion of the actuator (4) into rotational motion of each blade (10) in a radial direction relative to the axis of the hub; a resilient member communicating from one end with the actuator; a threaded shaft (5) communicating with the resilient member from its other end; the threaded shaft being in threaded communication with a conical piece (9) provided to an end (3.5) of the hub (3); wherein the threaded shaft (5) comprises a groove (5.2) for receiving a wrench (11) for rotatably advancing said shaft, and moving said actuator relative to said hub.

2. The self-adjustable pitch propeller according to claim 1, further comprises a shaft sleeve (6) fitted coaxially on the propeller shaft (1), wherein the actuator (4) is provided on the shaft sleeve (6) such that the actuator (4) can make a linear move thereon.

3. The self-adjustable pitch propeller according to claim 1, wherein the actuator (4) comprises actuator slots (4.2) radially arranged thereon.

4. The self-adjustable pitch propeller according to claim 1, wherein the actuator (4) extends in a longitudinal direction and comprises longitudinal actuator advancing surfaces (4.1) entering into the hub cavity (3.1).

5. The self-adjustable pitch propeller according to claim 4, wherein the cross sectional geometry of the hub cavity (3.1) is at least partially compatible with the cross sectional geometry of the actuator (4) and the cross sectional geometries thereof comprise a cornered geometry as a pentagon, hexagon or square.

6. The self-adjustable pitch propeller according to claim 4, wherein the actuator (4) comprises circularly arranged rods (4.4) extending from the actuator advancing surfaces (4.1) and an actuator disc (4.6) connected to the rods (4.4).

7. The self-adjustable pitch propeller according to claim 1, wherein the inner portion of the actuator (4) comprises an axial cavity having a circular cross section along the axis thereof; and the axial cavity of the actuator is dimensioned so as to sit on the propeller shaft (1) and to linearly move thereon.

8. The self-adjustable pitch propeller according to claim 1, wherein the motion transmission means (10.2) has a disc-like form and comprises a motion transmission pin (10.3) provided apart from the center thereof and extending in the axial direction therefrom, wherein the motion transmission pin (10.3) is receivable by the actuator slots (4.2).

9. The self-adjustable pitch propeller according to claim 8, wherein each motion transmission means (10.2) is fixedly connected to its respective blade (10) and each motion transmission means (10.2) being movable relative to the hub (3).

10. The self-adjustable pitch propeller according to claim 1, wherein the resilient member is a mechanical spring.

11. The self-adjustable pitch propeller according to claim 1, wherein the resilient member communicates with the actuator (4) from one end; and communicating with a support plate (13) fixed to the shaft (5) from other end.

12. The self-adjustable pitch propeller according to claim 11, wherein the resilient member is a rubber or a compressible fluid.

* * * * *